United States Patent [19]

Harris et al.

[11] Patent Number: 4,494,710

[45] Date of Patent: Jan. 22, 1985

[54] REEL BRAKE APPARATUS

[76] Inventors: Michael J. Harris, P.O. Box 23127, Auston, Tex. 78735; Kenneth N. Livingston, 10601 Sabo #182, Houston, Tex. 77089

[21] Appl. No.: 547,957

[22] Filed: Nov. 2, 1983

[51] Int. Cl.[3] ..... B65H 59/04

[52] U.S. Cl. ..... 242/156; 188/83; 188/166; 242/86.7; 242/99

[58] Field of Search ..... 242/156, 156.2, 86.7, 242/86.5 R, 86.5 A, 99, 75.4, 129.8, 54 R; 188/83, 166

[56] References Cited

U.S. PATENT DOCUMENTS

| | | | |
|---|---|---|---|
| 575,016 | 1/1897 | Towne | 188/83 |
| 1,780,194 | 11/1930 | Kende | 188/83 |
| 2,384,561 | 9/1945 | Muffett | 188/83 X |
| 2,635,827 | 4/1953 | Stemm et al. | 242/86.7 |
| 2,981,496 | 4/1961 | Harmon et al. | 242/156.2 X |
| 3,248,068 | 4/1966 | Slepicka | 242/86.7 |
| 3,323,752 | 6/1967 | Kurtz et al. | 242/156 X |

*Primary Examiner*—Stanley N. Gilreath
*Attorney, Agent, or Firm*—Robert K. Youtie

[57] ABSTRACT

A reel brake apparatus including an arbor, a hub structure on the arbor to support a reel for axial rotation while limiting axial movement of the reel, a friction plate for movement with the reel at one end thereof, a fixed pressure plate, and pressure pad assemblies extending from the pressure plate into resiliently yieldable frictional engagement with a friction plate.

6 Claims, 3 Drawing Figures

FIG. 1
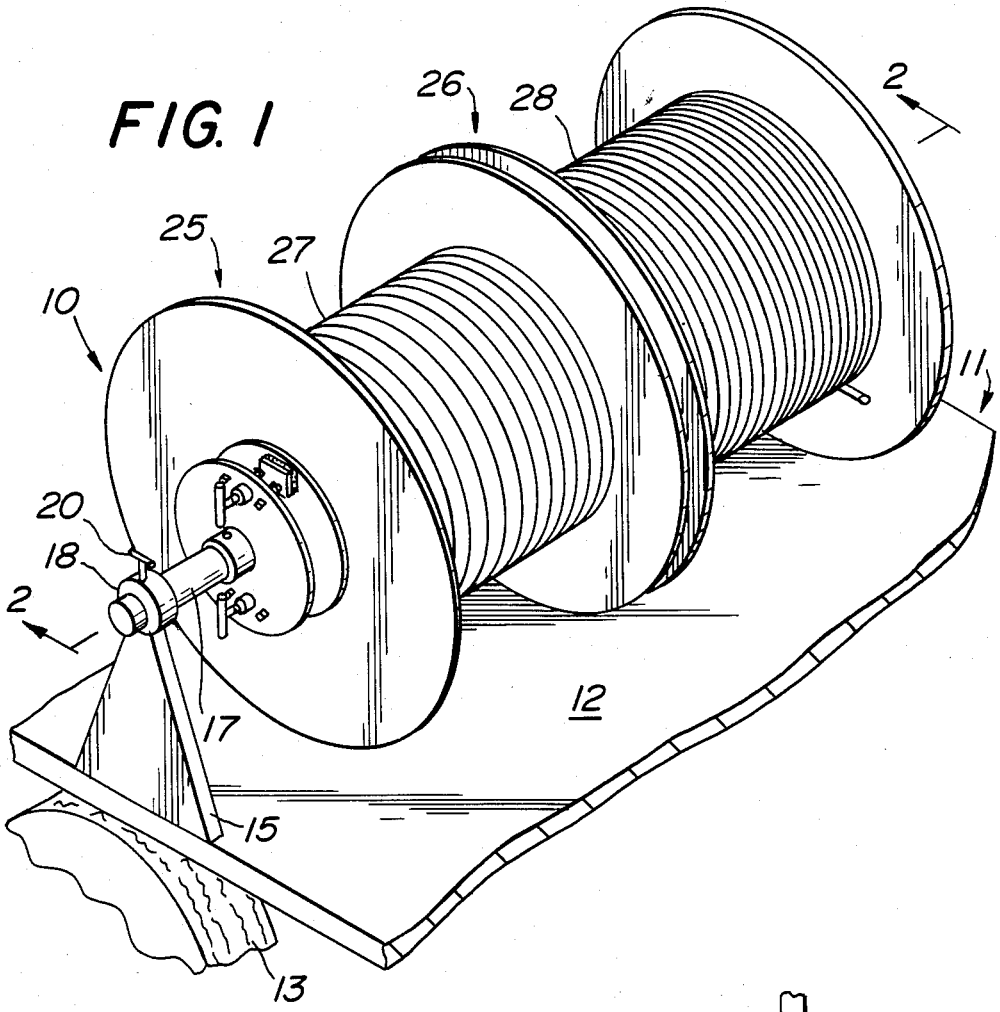
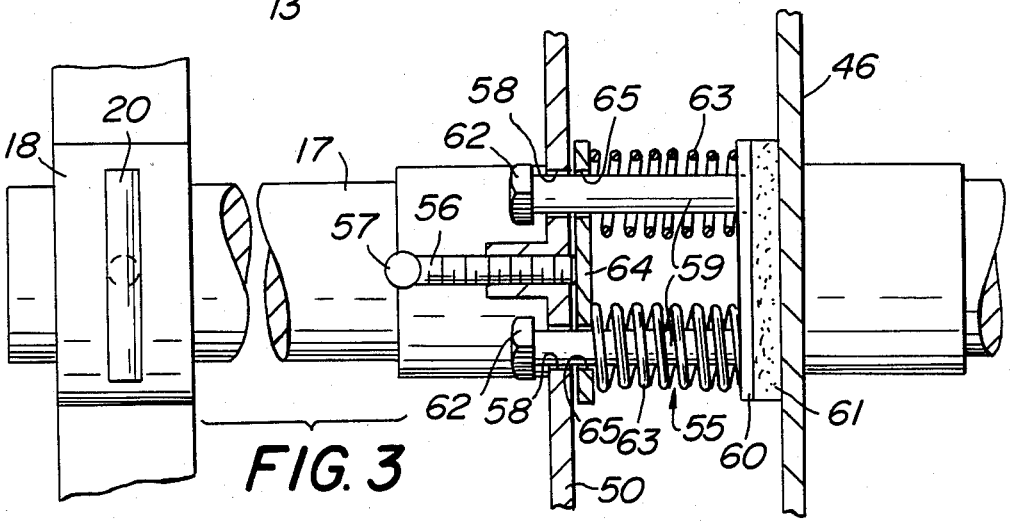
FIG. 3

REEL BRAKE APPARATUS

BACKGROUND OF THE INVENTION

As is well known in cable installation, the smooth unwinding of cable from its reel, so that the reel rotation accomodates to cable withdrawal while maintaining the cable under substantially constant tension, is highly desirable and essential to high speed operation and good quality of results.

While it has been attemped in the prior art to obtain smooth unreeling operation in cable installation, the apparatus has not been well adapted to operation with reels of different sizes and types, or out-of-true reels, which are quite common due to attempted economies. Hence, prior art devices have been subject to jerking, wobbling and erratic unwinding rotation, causing excessive slack in the cable and high variations in tension applied to the cable during the installation.

Examples of prior art devices of which applicants are aware are as follows:

| U.S. Pat. No. | PATENTEE |
|---|---|
| 2,213,764 | Hermann |
| 2,924,869 | Klein et al. |
| 2,948,483 | Petersen |
| 3,091,413 | Leithiser |
| 3,586,256 | Wellman |
| 4,131,241 | Meier |
| 4,190,211 | Janzen |
| 4,325,522 | Sauber |
| 4,353,515 | Weaver et al. |
| 4,365,768 | Woodruff |

SUMMARY OF THE INVENTION

It is an important object of the present invention to provide a cable reel brake assembly, as for mounting on a truck, trailer or other vehicle, which is adapted to accept reels of different sizes, shapes and conditions, while assuring smooth and even unreeling of cable and maintenance of a substantially constant tension in the cable so as to permit of rapid and easy cable removal without developing excessive slack in the cable.

It is a further object of the present invention to provide a cable reel brake apparatus which is quickly and easily adjustable to provide a desired cable tension while braking reels of different sizes, types and conditions, including warped ends and out-of-round cores.

It is another object of the present invention to provide a cable reel apparatus having the advantageous characteristics mentioned in the preceding paragraph, which enables a plurality of reels to be mounted on a single arbor for unreeling operation in smooth and even manner, independently of each other, and enabling different reels to be unreeled at different cable tensions, as desired.

It is still another object of the present invention to provide a cable reel brake apparatus of the type described which is extremely simple in construction, for economy in manufacture, as well as reliability and durability throughout a long useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a reel brake apparatus of the present invention operatively mounted on a suitable carrier or vehicle.

FIG. 3 is a sectional view taken generally along the line 3—3 of FIG. 2.

DESCRIPTION OF THE PREFERRED EMBODIMENT

Figure 2:
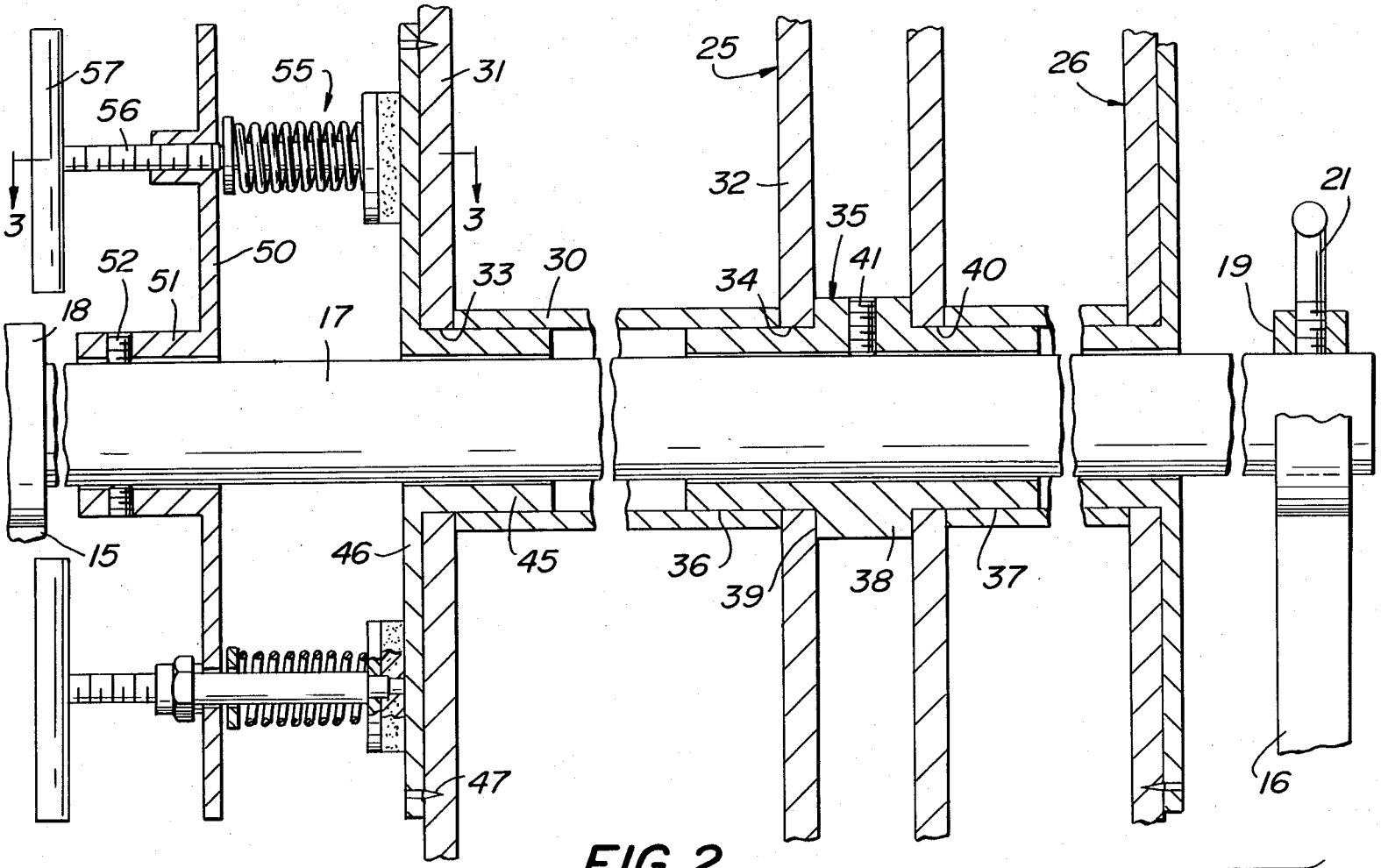
FIG. 2 is a sectional view generally along the line 2—2 longitudinally of the reel brake apparatus, with parts broken away.

Referring now more particularly to the drawings, and specifically to FIG. 1 thereof, a reel brake apparatus of the present invention is there generally designated 10, and is shown as mounted on a vehicle 11. The vehicle 11 is shown in part, as including a bed 12 carried on suitable running gear or wheels 13.

At each side of the vehicle bed 12 there may be an upstanding stanchion, block or standard 15 and 16, see FIGS. 1 and 2 for supporting therebetween a shaft, axle or arbor 17. Each stanchion or post 15 and 16 may include at its upper end a receiver or sleeve, as at 18 and 19, respectively, for slidably receiving opposite end portions of the shaft or arbor 17. The shaft or arbor 17 may be held against rotation by set screws 20 and 21 extending radially through and in threaded engagement with respective sleeves 18 and 19 for fast securement to adjacent end portions of arbor 17.

Circumposed coaxially about the shaft or arbor 17 are shown a pair of reels at 25 and 26, containing coiled cable 27 and 28, respectively. The reels 25 and 26 may be the same, as illustrated, or may be different, as required by the circumstances of cable installation. It is understood that the reel brake apparatus 10 may include the same structure at both ends of the arbor 17, although only a single such brake structure is shown. In particular, the reel 25 may include a central cylinder, spool or core 30 having circumferential end walls or flanges 31 and 32. The internal diameter of the reel 25 may be determined by the central opening 33 and 34 of the reel ends 31 and 32, or by the internal diameter of the core 30, both being the same in the illustrated embodiment. In practice, the reel end walls 31 and 32 are conventionally of wood or other readily impaled material.

A hub element is shown at 35, being generally cylindrical and slidably circumposed about the arbor 17. In particular, the cylindrical hub element 35 has its external end portions 36 and 37 of a suitable diameter for conforming engagement into the internal diameter of the reels to be used. In the illustrated embodiment, the cylindrical end portion 36 of hub element 35 conformably engages into the central opening 34 of reel end wall 32. Immediately between the ends of the cylindrical hub element 35, there is provided thereabout an annular land or rib 38 having its opposite sides defining axially facing annular shoulders 39 and 40. The shoulder 39 is engageable with the reel end wall 32 to limit axial movement of the reel, for a purpose appearing presently. In addition, the hub element 35 may include a radial extending set screw 41 for effectively securing the hub element in a desired position on the shaft or arbor 17.

An additional cylindrical hub element or sleeve 45 is slidably and rotatably circumposed about the arbor 17, extending conformably into the central opening 33 of reel end wall 31 and the interior of reel core 30. A circumferential external flange 46 on the cylindrical hub element 45 extends radially outwardly in facing engagement with the exterior of reel end wall 31. The circular flange 46 defines an annular frictional plate integral with one end of the hub element 45 and normal to the shaft or arbor 17; and is provided with impaling elements 47 for penetration into the contiguous reel end wall 31, or other suitable nonrotative interengaging means between the pressure plate 46 and reel 25.

Thus, it will be apparent that the reel 25 is rotatable about the arbor 17, being rotatable together with the hub part 45 and relative to the hub part 35.

Outward of the reel 25, on the opposite side thereof as the hub element 35, and fixedly circumposed about the arbor 17 is an annular pressure plate 50, which may be releasably fixed to the arbor by a central sleeve 51 slidably circumposed about the arbor and secured thereto by fasteners or set screws 52. The pressure plate 50 is generally normal to the arbor 17, being in parallel spaced facing relation with the friction plate 46.

Extending from the pressure plate, at diametrically opposed locations thereon, other equally angularly spaced relation thereabout, are pressure pad assemblies 55, being illustrated as two in number and identical to each other. The pressure pad assembly is shown in particular detail in FIG. 3, there including an elongate threaded member or adjustment screw 56 extending in threaded engagement through the pressure plate 50. One end of the adjustment member 56, outward of the pressure plate 50 away from the reel 25 may be provided with manually actuable rotating means, such as a hand grip cross member 57, or the like. Provided in the pressure plate 50, on opposite sides of and aligned with the adjustment member 56, along a line normal to the radius from arbor 17 to adjustment member 56, are a pair of through openings or holes 58. A pair of elongate rods or shanks 59 extend spacedly through respective holes 58 toward the friction plate 46. On the ends of rods or shanks 59 toward the friction plate 46 there is secured an elongate plate or backing member 60, which may carry a conformably configured brake pad 61. The shanks 59 have their ends remote from the backing member 60 enlarged or headed, as at 62, on the opposite side of pressure plate 50 as the reel 25, so as to retain the pressure pad assembly 55 associated with the pressure plate.

The pressure pad 61 is urged toward the friction plate 46, rightward as seen in the drawings, by suitable resilient means. Specifically, a coil compression spring 63 is circumposed about each shank or rod 59; and a cross member or head 64 is interposed between the pressure plate 50 and springs 63. More specifically, the head member or plate 64 is provided with through openings 65 loosely receiving respective shanks 59, and extends across the inner end of adjustment member 56. Thus, by inward screwing of adjustment member 56, toward friction plate 46, the springs 63 are compressed between the head plate 64 and backing member 60 to increase the pressure applied between brake pad 61 and friction plate 46. This pressure is adjustable, as desired, to equalize pressure between the friction plate 46 and both pad assemblies 55, as well as to select a desired pressure to achieve optimum cable tension upon unwinding.

In addition to the relatively true rotative motion of the reel 25 as effected by its rotation on part 35 and together with part 45; a relatively constant uniform braking action is applied to the reel by reason of the relative planarity of friction plate 46 as compared to possibly warped or otherwise misaligned reel ends. Also, the brake pads 61 are maintained in maximum surface engagement with the friction plate 46 under widely varying conditions by reason of the resiliently tiltable and yieldable mounting of the brake pads 61 with respect to the pressure plate 50. That is, by the clearance fit of shanks or rods 59 through the holes 58 and 65, the backing member 60 and brake pads 61 are tiltable to maintain flat surface engagement at all times with the friction plate 46, and the friction pads 61 is retractable toward the pressure plate to accomodate to variations in the reel 25 and friction plate 46. Also, by the arrangement of friction pad 61 generally normal to a radius from the arbor 17, the friction pad is aided in maintaining its maximum surface engagement with the friction plate. This tiltability is further enhanced by the absence of positive connection between the adjustment member 56 and head member or spring retainer plate 64, whereby the latter is also afforded a degree of tiltability relative to the pressure plate 50.

While the above described combination is operative to effectively brake the reel 25 independently of the reel 26, there may be provided a suitable braking mechanism of the same type between the standard 16 and reel 26, as desired.

From the foregoing, it is seen that the present invention provides a reel brake apparatus which assures uniform and even unreeling under substantially constant cable tension regardless of surrounding conditions, which apparatus is extremely simple and economical, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A reel brake apparatus comprising an arbor, hub means on the arbor for rotatably supporting and axially locating a reel circumposed about said arbor, a friction plate circumposed about said arbor and removably engageable with one end of a reel for rotation with the reel, a fixed pressure plate circumposed about said arbor in facing spaced relation with said friction plate, a plurality of pressure pad assemblies carried by said pressure plate at angularly spaced locations thereabout, said pressure pad assemblies extending from said pressure plate toward and into frictional engagement with said friction plate, an elongate member extending generally normal to said pressure plate and adjustable longitudinally toward and away from said friction plate, a head on said elongate member facing toward said friction plate, a pad backing member between said head and friction plate, a shank on said pad backing member extending freely through said head, and spring means interposed between said head and backing member urging the latter toward said friction plate.

2. A reel brake apparatus according to claim 1, in combination with a brake pad on said backing member, said shank having one end extending freely through and beyond said pressure plate, and an enlargement on said one end of said shank for retaining the latter with respect to said pressure plate.

3. A reel brake apparatus comprising an arbor, hub means on the arbor for rotatably supporting and axially locating a reel circumposed about said arbor, a friction plate circumposed about said arbor and removably engageable with one end of a reel for rotation with the reel, a fixed pressure plate circumposed about said arbor in facing spaced relation with said friction plate, a plurality of pressure pad assemblies carried by said pressure plate at angularly spaced locations thereabout, said pressure pad assemblies extending from said pressure plate toward and into frictional engagement with said friction plate, a shaft extending in threaded engagement with and through said pressure plate for adjustable positioning toward and away from said friction plate, a transverse head at an end of said shaft between said pressure and friction plates, a pad backing member between said head friction plate, and a plurality of shanks extending from said backing member symmetrically of said shaft and freely through said head, and spring means interposed between said head and backing member urging the latter toward said friction plate.

4. A reel brake apparatus according to claim 3, said spring means comprising a coil compression spring circumposed about each of said shanks.

5. A reel brake apparatus according to claim 4, said hub means comprising a sleeve fixed to said friction plate and rotatably circumposed about said arbor for centrally supporting an end of a reel.

6. A reel brake apparatus according to claim 5, said hub means further comprising a second sleeve having a shoulder and removably fixed to said arbor for centrally supporting the other end of the reel in limiting engagement with the shoulder.

* * * * *